United States Patent [19]

Friant et al.

[11] 4,042,431

[45] Aug. 16, 1977

[54] TWO COMPONENT FIELD MIX HYDRAZINE BASE EXPLOSIVE

[75] Inventors: James E. Friant; Marshall E. Klopich, both of Renton, Wash.

[73] Assignee: Rocket Research Corporation, Redmond, Wash.

[21] Appl. No.: 596,763

[22] Filed: July 17, 1975

[51] Int. Cl.[2] ..... C06B 47/08

[52] U.S. Cl. ..... 149/36; 149/46; 102/24 R

[58] Field of Search ..... 149/36, 46; 102/24 R

[56] References Cited

U.S. PATENT DOCUMENTS

| | | | |
|---|---|---|---|
| 2,943,927 | 7/1960 | Audrieth et al. | 149/36 |
| 2,978,864 | 4/1961 | Stengel | 149/36 X |
| 3,197,348 | 7/1965 | Skolnik | 149/36 X |
| 3,419,443 | 12/1968 | Maes | 149/36 X |
| 3,730,909 | 5/1973 | Armstrong et al. | 149/36 X |
| 3,768,410 | 10/1973 | Maes et al. | 149/36 X |

*Primary Examiner*—Edward A. Miller

*Attorney, Agent, or Firm*—Graybeal, Barnard & Uhlir

[57] ABSTRACT

A two component field mix explosive composition comprising a first solid component comprising ammonium nitrate or mixtures of ammonium nitrate with ammonium perchlorate, and a second liquid component comprising as a first ingredient hydrazine, a second ingredient which is water, alcohol or a mixture thereof, and as a third ingredient ammonium nitrate in an amount no greater than about one-sixth of the total weight of the second component. At the site of use the liquid component is poured into the solid component to form an explosive composition. This composition is detonable in elongate packages as small as one inch in diameter, by use of a blasting cap.

38 Claims, No Drawings

TWO COMPONENT FIELD MIX HYDRAZINE BASE EXPLOSIVE

BACKGROUND OF THE INVENTION

1. Field of the Invention

This invention relates to a two component explosive composition particularly adapted for field mixing.

2. Description of the Prior Art

There are in the prior art various two component explosives, in which each component by itself is nondetonable, and the two components can be mixed together to form an explosive composition. Quite commonly one of the components is a solid and the other a liquid, with the mixing being accomplished by pouring the liquid into the solid. One of the most common two component explosives is made by adding about 5% fuel oil to about 95% ammonium nitrate to make an explosive mixture commonly called "ANFO". However, for detonation, this mixture requires a powerful booster and critical diameters of approximately three inches or more.

A common practice is to detonate an explosive in a borehole that is drilled into a ground formation. One method of placing the explosive in the borehole is to prepackage the explosive in a number of elongate tubular packages, and then arrange these packages in end to end relationship to form an explosive train that is inserted into the borehole. A detonator is inserted into the end cartridge to initiate the explosive reaction.

An explosive composition suitable for field mixing and detonation in boreholes, as described above, is that disclosed in U.S. Pat. No. 3,768,410, issued Oct. 3, 1973 and assigned to the assignee of the present invention. In this explosive composition there is a first solid component made up of ammonium nitrate or mixtures of ammonium nitrate with ammonium perchlorate or the like, and a second liquid component made up of hydrazine and water. The ratio of the liquid to solid component is about one to two parts liquid component to about 15 parts solid component, with the preferred ratio being about 1 to 10. For maximum safety, the amount by weight of water in the liquid component is at least about equal to, or slightly greater than, the amount of hydrazine. This ratio is particularly advantageous since the hydrazine with at least an equal amount of water can be shipped by common commercial transportation as a separate component without hazardous comodity labels, as can the solid component which is ammonium nitrate. A package of this explosive mixture with a diameter down to about 1 ½inches can be detonated in a borehole by use of a blasting cap.

By way of further background information, in U.S. Pat. No. 3,419,443, Maes, there is disclosed an explosive composition comprising hydrazinium nitrate, hydrazine and ammonia, with or without hydrazinium perchlorate. This explosive composition has been formulated as a two component explosive, where ammonium nitrate is the solid component and hydrazine is the liquid component, in a ratio of about two parts solid to one part liquid component. In some formulations a portion of the ammonium nitrate is dissolved in the liquid hydrazine in the premix condition. However, this is done primarily to lower the freezing point of the liquid component. A second reason for doing this is that adding hydrazine to ammonium nitrate gives off gaseous ammonia which can cause the mixture to foam or bubble to an undesired extent. By premixing some of the ammonium nitrate with the hydrazine, some of the ammonia can be boiled off in the preparation of the premix components, so that this foaming can be reduced in the mixing of the two components to make the explosive composition. Other related patents are Audrieth et al, U.S. Pat. No. 2,943,927; Audrieth et al, U.S. Pat. No. 2,704,706; Hradel, U.S. Pat. No. 3,124,495; Stengel, U.S. Pat. No. 2,978,864; Stengel et al, U.S. Pat. No. 3,061,489; and Rank et al, U.S. Pat. No. 3,558,749.

SUMMARY OF THE INVENTION

The present invention is an adaptation of the explosive composition disclosed in the above mentioned U.S. Pat. No. 3,768,410, and is especially adapted for simple field mixing and reliable detonation in boreholes down to about one inch in diameter.

The solid component of the two component explosive is selected from a group consisting of ammonium nitrate and mixtures of ammonium nitrate with ammonium perchlorate or the like, with the amount of the ammonium nitrate being at least about half the total weight of the solid component. In a preferred formulation, the ratio of ammonium perchlorate to the total mix is between about 0 to 1 part ammonium perchlorate to 5 parts total weight of solid component. In a specific preferred formulation, the ammonium perchlorate is 10% of the weight of the total solid component.

The liquid component comprises as a first ingredient hydrazine; a second ingredient selected from a group consisting of water, a compatible liquid fuel ingredient, desirably alcohol, and mixtures thereof; and ammonium nitrate in an amount no greater than about one-sixth of the total weight of the liquid component. Although the amount of ammonium nitrate that is added to the liquid component is only about 1% (or slightly greater) by weight of the final explosive mix, it has been found that with the formulation recited above, the resulting explosive composition is cap sensitive, and can detonate in an explosive column train in a borehole where the explosive is down to about 1 inch in diameter.

The hydrazine is present in an amount between about two-fifths to about two-thirds of the total weight of the liquid component. The second ingredient (i.e. water, liquid fuel constituent or mixtures thereof) is present in an amount between about one-half the amount of hydrazine and an amount moderately greater than the amount of hydrazine. The ammonium nitrate is present in an amount no greater than about one-sixth of the total weight of the liquid component, and in one preferred formulation is present in about 13% by weight of the total liquid component and in a second preferred formulation is present in about 9% by weight of the total liquid component.

At the location of use, the liquid component is simply poured into the solid component. In the application for which this explosive is especially adapted, the solid component is contained in its premixed condition in an elongate tubular package, as small as 1 inch in diameter. The liquid component is simply poured into the top end of the package, which is then permitted to set for a short period of time (e.g. 5 to 30 minutes). The resulting explosive mixture is detonable by itself or in an explosive column train, by means of a blasting cap.

DESCRIPTION OF THE PREFERRED EMBODIMENT

The present invention comprises a safe two part explosive adapted for field use, characterized by a solid component, preferably in granular form, and a liquid component.

The solid component is ammonium nitrate, or a mixture of ammonium nitrate with a compatible oxidizer salt, such as ammonium perchlorate or the like (which would include salts having ammonia or a metal as the catanionic radical and nitrate or perchlorate as the anionic radical). For example, ammonium perchlorate can be added to the ammonium nitrate for improved detonation characteristics up to a practical limit of about 50% by weight of the total weight of the solid component. Additional amounts of ammonium perchlorate increases sensitivity of the explosive to create handling hazards beyond practical commercial standards. In the preferred formulation, the ammonium perchlorate is no greater than about 20% and desirably about 10% by weight of the total weight of the solid component. Also, compatible fuel constituents, such as carbon black, sugar, coated aluminum powder or ground up polyethylene can be added, if desired, for example in an amount of about 10% by weight of the total solid component. While greater amounts can be added, this often times results in incomplete combustion of the added fuel constituents and thus provides no real advantage.

The ammonium nitrate is desirably in the form of prills, such as a standard fertilizer grade prill. Such prills have a very light inorganic coating, e.g. one made up of talc and possibly some other ingredients, which has been found not to impair detonation characteristics of the explosive composition. Fertilizer grade U.S. Steel prills have been found to be satisfactory. If the ammonium nitrate is too fine (e.g. in powdered form), it is more difficult for the liquid component to flow through the solid component and proper mixing is impaired, particularly in field mix conditions. Ammonium nitrate prills ranging in size where all the prill pass a screen of eight mesh per inch and 94% of which are retained on a screen of twenty mesh per inch have been found to be satisfactory for use in the present invention. The ammonium perchlorate is in granule form of a nominal one hundred mesh size which specifies that 99% of the ammonium perchlorate pass a 65 mesh screen. In finer granule sizes the perchlorate tends to migrate out of the solid component and inhibits mixture.

The liquid component comprises hydrazine as a first ingredient, a second ingredient selected from a group consisting of water, a compatible liquid fuel constituent (desirably alcohol) and mixtures thereof; and a third ingredient which is ammonium nitrate dissolved in the liquid in an amount no greater than about one-sixth of the total weight of the liquid component.

The amount of hydrazine is between two-fifths to two-thirds of the total liquid component by weight. The amount of the second ingredient is between about one-half the amount of hydrazine and an amount moderately greater than the amount of hydrazine. For maximal safety the amount of the second ingredient is by weight at least equal to, or slightly greater than, the amount by weight of hydrazine. This ratio is particularly advantageous since the hydrazine with at least an equal amount of the second ingredient can be shipped by common commercial transportation without hazardous commodity labels. A readily available form of hydrazine is in the form of hydrazine hydrate, which is approximately two parts by weight hydrazine to one part by weight of water. When hydrazine hydrate is used, the water portion of the hydrazine hydrate functions as a part of the second ingredient. Additional amounts of the second ingredient can be added to increase the weight of the second ingredient to slightly greater than the weight of the hydrazine.

It is known that certain aliphatic derivatives of hydrazine, namely, monomethylhydrazine and unsymmetrical dimethylhydrazine and mixture thereof with hydrazine, function in an equivalent manner in explosive compositions and these equivalent compounds are to be considered the equivalents of hydrazine for purposes of practice of the present invention.

In the preferred formulation of the present invention, the second ingredient is made up of water and alcohol, with the amount of water by weight being moderately greater than that of the alcohol. Since hydrazine hydrate is a readily available form of hydrazine, a convenient method of preparation of the first two ingredient is to add the alcohol to the hydrazinium hydrate. In one preferred formulation, the proportioning of the hydrazine, water and alcohol is 50 to 29 to 21.

The third ingredient of the liquid component is a small amount of ammonium nitrate dissolved in the first and second liquid ingredients of the liquid component. The amount of ammonium nitrate should be no greater than about one-sixth by weight of the total weight of the liquid component. In one preferred formulation, the amount of ammonium nitrate is 13% by weight of the total liquid component and in a second formulation 9% by weight of the total liquid component. While lesser amounts of ammonium nitrate in the liquid component can be used to produce some desired effect, such lesser amounts are not as effective as those recited above.

Even though the amount of ammonium nitrate added to the liquid ingredient is a very small percentage (in the order of 1% and no greater than 2%) of the total weight of ammonium nitrate in the solid component, it has been found that the addition of this quite small amount of ammonium nitrate to the liquid component significantly enhances the performance of the explosive composition. This particular formulation permits the field mixing of the two components in a configuration where the diameter of the explosive composition is as small as 1 inch in diameter, with the mixing being able to be reliably accomplished simply by pouring the liquid component into the solid component.

In a typical field use situation, there are a plurality of elongate tubular packages (e.g. approximately) 1 foot long and having a diameter as low as 1 inch or 1¼ inches), each of which contains the solid component. The proper amount of liquid component is then poured into the upper end of each container, and the container sealed. If the amount of liquid component is too small, it is not sufficient to form a detonable explosive. On the other hand, if the amount of liquid is too great, excess liquid collects in the lower portion of the container and impairs propagation of the explosive reaction. The ratio of the liquid to solid component should be approximately between one to two parts liquid to 15 parts solid component by weight. In one preferred formulation, the weight of the solid component is 91.5% of the mixed explosive, with the liquid component being 8.5%. The packages of the mixed explosive composition are then stacked in an explosive column train, inserted in a borehole and detonated.

EXAMPLE I

The solid and liquid components of the explosive composition were formulated separately according to the following formulation.

Solid Component (% of mixed explosive): 91.5
Ammonium Nitrate: 89.9
Ammonium Perchlorate: 10
Inerts: 0.1
Liquid Component (% of mixed explosive): 8.5
$N_2H_4$: 43.48
$H_20$: 25.22
$CH_3OH$: 18.26
Ammonium Nitrate: 13.04

The solid component was placed in a plastic tubular container 11 inches long and 1¼ inches in diameter. The top of the container was opened and the liquid component was poured through the open top of the container into the solid component. The container was permitted to remain in an upright position for 5 minutes. A low power commercial detonator (a DuPont No. 6 blasting cap) was inserted into the explosive mixture at the top part of the container and fired. An explosion occurred and there was full propagation of the explosive reaction throughout the composition.

EXAMPLE II

The same procedure was followed as in Example I, except two tubular packages were prepared and were placed in end to end relationship. Upon firing of the detonator in the uppermost container, full propagation of the explosive reaction proceeded through both containers.

EXAMPLE III

The same procedure was followed as in Example II, except that four containers were placed in end to end relationship in a hole drilled in reinforced concrete. There was full propagation of the explosive reaction and excellent breakup of the concrete.

EXAMPLE IV

The same procedure was followed as in Example I, except that the container was stored for 24 hours after mixing of the two components. There was full propagation of the reaction.

EXAMPLE V

The same procedure was followed as in Example I, except that the container was stored for about 4 hours after mixing at minus 40° F., and was then successfully fired.

EXAMPLE VI

The same procedure was followed as in Example I, except that the container was stored for about 4 hours after mixing at 140° F., and was then successfully fired.

EXAMPLE VII

The same procedure was followed as in Example I, except that the ammonium nitrate added to the liquid component was 9% by weight of the total liquid component, with the other ingredients of the liquid component remaining in their same relative ratios. Upon detonation, there was full propagation of the explosive reaction throughout the composition.

What is claimed is:

1. A two component field mix explosive composition, comprising:

a. a first solid component selected from a group consisting of:
   1. ammonium nitrate,
   2. mixtures of ammonium nitrate with ammonium perchlorate or the like, with the amount of ammonium nitrate being at least about half the total weight of the first component, b. a second liquid component comprising:
   1. hydrazine in an amount between about two-fifths to two-thirds of the total weight of the second component,
   2. a second ingredient selected from a group consisting of water, a compatible liquid fuel and mixtures thereof in an amount between about half the amount of hydrazine to an amount by weight moderately greater than the hydrazine, and
   3. ammonium nitrate in an amount no greater than about one-sixth of the total weight of the second component, with the proportion of said second component to the first component being between about one to two parts by weight to about fifteen parts by weight of the solid component and present in an amount adequate to form an explosive composition.

2. The explosive composition as recited in claim 1, wherein there is about 0% to 20% ammonium perchlorate in said first component.

3. The explosive composition as recited in claim 2, wherein said first component comprises ammonium nitrate and ammonium perchlorate, with the ratio being about one part ammonium perchlorate to about nine parts ammonium nitrate.

4. The explosive composition as recited in claim 1, wherein the amount of the second ingredient of the second component is at least approximately equal to the amount of hydrazine.

5. The explosive composition as recited in claim 4, wherein the second ingredient of the second liquid component comprises water and liquid alcohol.

6. The explosive composition as recited in claim 5, wherein the water is approximately one-quarter by weight of the total weight of the second liquid component, and the remainder of the second ingredient comprises liquid alcohol.

7. The explosive composition as recited in claim 1, wherein there is in said first component about 0% to 20% ammonium perchlorate, and in said second component the second ingredient thereof is at least approximately equal to the amount of the hydrazine in the second component.

8. The explosive composition as recited in claim 7, wherein the second ingredient of the second liquid component comprises water and liquid alcohol.

9. The explosive composition as recited in claim 8, wherein the water is approximately one-quarter by weight of the total weight of the second liquid component, and the remainder of the second ingredient comprises liquid alcohol.

10. The explosive composition as recited in claim 1, wherein said first component comprises ammonium nitrate and ammonium perchlorate, with the ratio being about one part ammonium perchlorate to about nine parts ammonium nitrate, and said second component has as its second ingredient water and liquid alcohol, with the amount of water being approximately one-quarter of the total weight of the second component, and with the second ingredient being at least approximately equal by weight to the amount of hydrazine in the second component.

11. The explosive composition as recited in claim 10, wherein the ammonium nitrate in the second liquid component is present in an amount no greater than about 13% of the second component.

12. The explosive composition as recited in claim 11, wherein the ammonium nitrate in the second liquid component is present in an amount no greater than about 9% of the total weight of the second component.

13. The explosive composition as recited in claim 1, wherein the ammonium nitrate in the second liquid component is present in an amount no greater than about 13% of the second component.

14. The explosive composition as recited in claim 13, wherein the ammonium nitrate in the liquid component is present in an amount no greater than about 9% of the total weight of the second component.

15. The explosive composition as recited in claim 1, wherein the ratio of the second liquid component to the first solid component is by weight approximately one to eleven.

16. The explosive composition as recited in claim 15, wherein said first component comprises ammonium nitrate and ammonium perchlorate, with the ratio being about one part ammonium perchlorate to about nine parts ammonium nitrate, and said second component has as its second ingredient water and liquid alcohol, with the amount of water being approximately one-quarter of the total weight of the second component, and with the second ingredient being at least approximately equal by weight to the amount of hydrazine in the second component.

17. The explosive composition as recited in claim 1, wherein the ammonium nitrate of the first solid component is in the form of prills.

18. The explosive composition as recited in claim 17, wherein said prills are of a size which passes a screen of eight mesh per inch and the majority of which are retained on a screen of 20 mesh per inch.

19. A two component field mix explosive, comprising:

a. a first elongate tubular container containing a first solid component selected from a group consisting of:
   1. ammonium nitrate,
   2. mixtures of ammonium nitrate with ammonium perchlorate or the like, with the amount of ammonium nitrate being at least about half the total weight of the first component, b. a second liquid component in second containing means and adapted to be poured into the first container for mixing with the first solid component, said liquid component comprising:
   1. hydrazine in an amount between about two-fifths to two-thirds of the total weight of the second component,
   2. a second ingredient selected from a group consisting of water, a compatible liquid fuel and mixtures thereof in an amount between about half the amount of hydrazine to an amount by weight moderately greater than the hydrazine, and
   3. ammonium nitrate in an amount no greater than about one-sixth of the total weight of the second component, with the proportion of said component to the first component being between about one to two parts by weight to about 15 parts by weight of the solid component and present in an amount adequate to form an explosive composition.

20. The explosive as recited in claim 19, wherein said container has a diameter no greater than about 3 inches.

21. The explosive as recited in claim 20, wherein said first container has a diameter no greater than about 1½ inches.

22. The explosive as recited in claim 19, wherein there is about 0% to 20% ammonium perchlorate in said first component.

23. The explosive as recited in claim 22, wherein said first component comprises ammonium nitrate and ammonium perchlorate, with the ratio being about one part ammonium perchlorate to about nine parts ammonium nitrate.

24. The explosive as recited in claim 19, wherein the amount of the second ingredient of the second component is at least approximately equal to the amount of hydrazine.

25. The explosive as recited in claim 24, wherein the second ingredient of the second liquid component comprises water and liquid alcohol.

26. The explosive as recited in claim 25, wherein the water is approximately one-quarter by weight of the total weight of the second liquid component, and the remainder of the second ingredient comprises liquid alcohol.

27. The explosive as recited in claim 19, wherein there is in said first component about 0% to 20% ammonium perchlorate, and in said second component the second ingredient thereof is at least approximately equal to the amount of the hydrazine in the second component.

28. The explosive as recited in claim 27, wherein the second ingredient of the second liquid component comprises water and liquid alcohol.

29. The explosive as recited in claim 28, wherein the water is approximately one-quarter by weight of the total weight of the second liquid component, and the remainder of the second ingredient comprises liquid alcohol.

30. The explosive as recited in claim 1, wherein said first component comprises ammonium nitrate and ammonium perchlorate, with the ratio being about one part ammonium perchlorate to about nine parts ammonium nitrate, and said second component has as its second ingredient water and liquid alcohol, with the amount of water being approximately one-quarter of the total weight of the second component, and with the second ingredient being at least approximately equal by weight to the amount of hydrazine in the second component.

31. The explosive as recited in claim 30, wherein the ammonium nitrate in the second liquid component is present in an amount no greater than 13% of the second component.

32. The explosive as recited in claim 31, wherein the ammonium nitrate in the second liquid component is present in an amount no greater than about 9% of the total weight of the second component.

33. The explosive as recited in claim 19, wherein the ammonium nitrate in the second liquid component is present in an amount no greater than about 13% of the second component.

34. The explosive as recited in claim 33, wherein the ammonium nitrate in the liquid component is present in an amount no greater than about 9% of the total weight of the second component.

35. The explosive as recited in claim 19, wherein the ratio of the second liquid component to the first solid component is by weight approximately 1 to 11.

36. The explosive as recited in claim 35, wherein said first component comprises ammonium nitrate and ammonium perchlorate, with the ratio being about one part ammonium perchlorate to about nine parts ammonium nitrate, and said second component has as its second ingredient water and liquid alcohol, with the amount of water being approximately one-quarter of the total weight of the second component, and with the second ingredient being at least approximately equal by weight to the amount of hydrazine in the second component.

37. The explosive as recited in claim 19, wherein the ammonium nitrate of the first solid component is in the form of prills.

38. The explosive composition as recited in claim 37, wherein said prills are of a size which passes a screen of eight mesh per inch and the majority of which are retained on a screen of twenty mesh per inch.

* * * * *